US006907647B2

(12) United States Patent
Kopatz

(10) Patent No.: US 6,907,647 B2
(45) Date of Patent: Jun. 21, 2005

(54) EYELET FOR REINFORCING THE EDGE OF A HOLE IN A CARRIER STRIP AND DEVICE FOR ATTACHING AN EYELET TO A CARRIER STRIP

(75) Inventor: Heinz-Dieter Kopatz, Alsdorf (DE)

(73) Assignee: William Prym GmbH & Co. KG, Stolberg (DE)

( * ) Notice: Subject to any disclaimer, the term of this patent is extended or adjusted under 35 U.S.C. 154(b) by 0 days.

(21) Appl. No.: 10/333,873

(22) PCT Filed: Jun. 2, 2001

(86) PCT No.: PCT/EP01/06316

§ 371 (c)(1),
(2), (4) Date: Jan. 24, 2003

(87) PCT Pub. No.: WO02/13646

PCT Pub. Date: Feb. 21, 2002

(65) Prior Publication Data

US 2003/0167610 A1 Sep. 11, 2003

(30) Foreign Application Priority Data

Aug. 12, 2000 (DE) ..... 100 39 462
Mar. 9, 2001 (DE) ..... 201 04 102 U

(51) Int. Cl.[7] ..... A43C 5/00; A43D 100/00

(52) U.S. Cl. ..... 24/713.7; 24/713.8; 24/715.1; 24/326; 24/114.3; 24/101 R; 227/15; 227/21; 411/479

(58) Field of Search ..... 24/713.7, 713.8, 24/715.1, 326, 114.3, 101 R; 227/15, 21; 411/479

(56) References Cited

U.S. PATENT DOCUMENTS 1,565,523 A 12/1925 Stuart
1,838,973 A 12/1931 Wilder
2,101,060 A * 12/1937 Gookin ..... 24/713.7
2,107,375 A 2/1938 Gookin
2,143,087 A * 1/1939 Rau ..... 24/713.7
2,901,800 A * 9/1959 Koehl ..... 24/713.7
3,328,854 A * 7/1967 Tombari ..... 24/713.7
4,479,287 A * 10/1984 Asaka ..... 24/141
4,890,362 A * 1/1990 Odajima et al. ..... 24/713.7
5,588,191 A * 12/1996 Slbeck ..... 24/713.8

FOREIGN PATENT DOCUMENTS

DE 299 03 124 U1 6/1999
EP 0673611 9/1995
FR 1577474 6/1969

* cited by examiner

*Primary Examiner*—Victor Sakran
(74) *Attorney, Agent, or Firm*—Friedrich Kueffner

(57) ABSTRACT

The invention relates to a ringless eyelet (10') comprising a plate (11) arranged on the display side (23) of the carrier strip (20), and a tube-shaped collar penetrating the hole in the carrier strip. The hem of the collar of the eyelet element (10') is supported on the rear side (24) of the carrier strip (20). The aim of the invention is to connect the eyelet to the carrier strip (20) faster and in a more cost-effective manner. In order to achieve this, the free end part of the collar of the eyelet element (10') is provided with projections (16). An essentially closed ring profile (50), into which the collar projections (16) are integrated, is created when the collar is hemmed. After hemming, pressure points (40) are created on the carrier strip (20) between the collar projections (16) and the abutment surfaces (49) formed by the plate (11), said pressure points reliably holding the carrier strip (20). Said carrier strip (20) extends namely inside (51) the ring profile (50) beyond the pressure points (40). An eyelet is obtained using only one.

11 Claims, 3 Drawing Sheets

FIG. 3
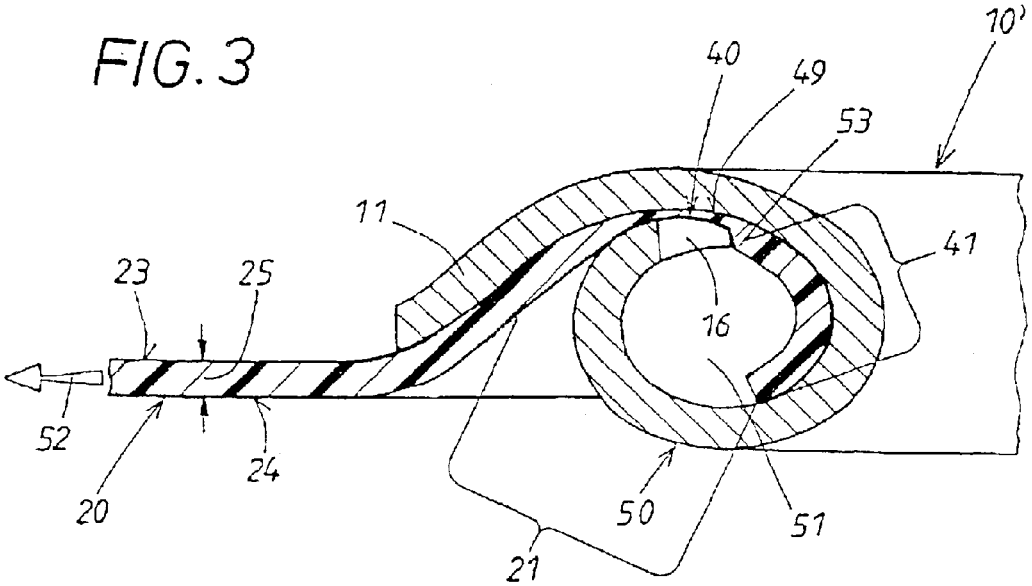
FIG. 4
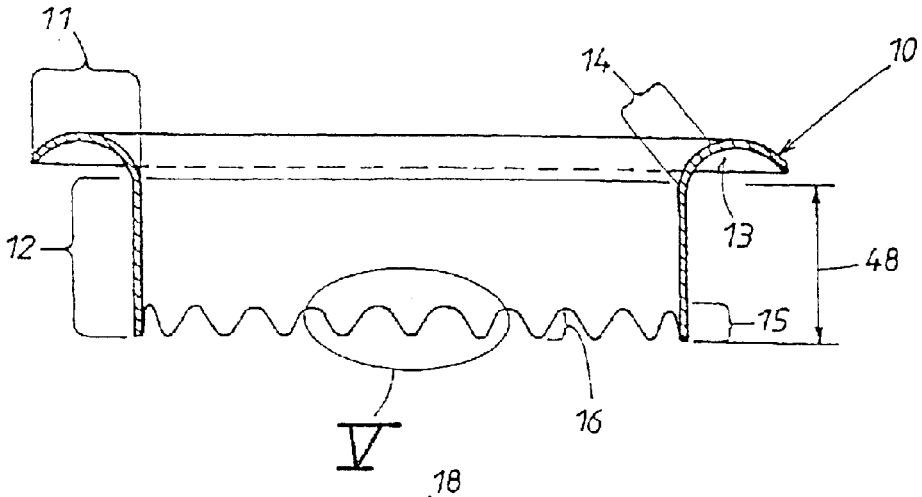
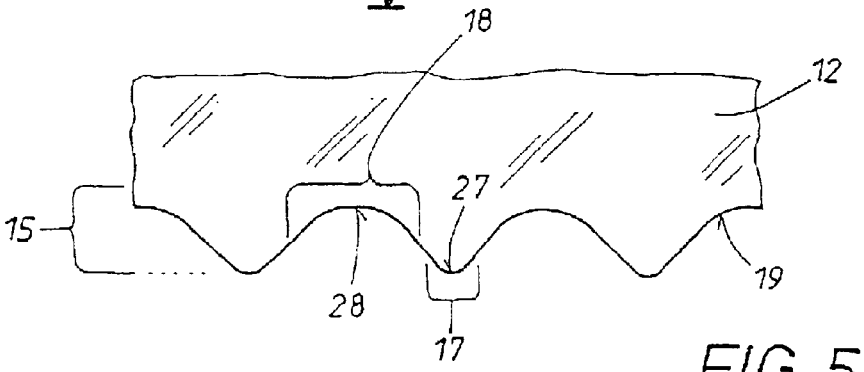
FIG. 5

EYELET FOR REINFORCING THE EDGE OF A HOLE IN A CARRIER STRIP AND DEVICE FOR ATTACHING AN EYELET TO A CARRIER STRIP

The invention pertains first to an eyelet of the type indicated in the introductory clause of claim 1. There are two-part eyelets, the first part of which consists of an eyelet, the second consisting of a disk. These two parts are located on opposite sides of the carrier web and clamp the carrier web between them in sandwich-like fashion.

One-part eyelets are also known, however, which do not have a disk part and which thus consist only of an eyelet part (U.S. Pat. No. 2,107,375 A). Pleats are formed in the end of the neck of the eyelet part, as a result of which radial expansions are created between axial projections. When the eyelet part is flanged over, a C-shaped profile is formed between the neck and the plate, the radial expansions being supported against the rear surface of the carrier web. The carrier web thus extends radially into the interior of the C-shaped profile. This known eyelet has limited resistance to pull-out.

In connection with a single-part eyelet comprising of an eyelet collar with a semi-circular profile and an eyelet neck with uniformly circumferentially extending V-shaped cross-section on the end face of the neck, it is known (EP 0 673611 A1) to close the resulting C-shaped profile to such an extent that the carrier web is clamped in the remaining gap between the outer edge of the eyelet collar and the end face of the eyelet neck. The semi-circular interior of the eyelet collar is divided by a peripheral annular rib into an inner and an outer groove wherein the annular rib over portions thereof carries pointed tips. The transition area between the eyelet neck and the eyelet collar is provided with conical stabilizing ribs which prevent flanging of these areas. After flanging of the residual length of the neck, the end face of the eyelet neck is aligned only with the outer groove of the eyelet collar. In the interior of the C-shaped profile, a labyrinth for the carrier web is provided. The tips of the annular rib appear to effect a holding action securing the carrier web against rotation but the tearing-out stability of the carrier web is insufficient because the topside of the carrier web is contacted only by the outer edge of the eyelet collar and the bottom side of the carrier web is only contacted by the end face of the eyelet neck.

Moreover, for a single-part eyelet it is also known (DE 299 03 124 U1) to cut the free end of the neck in the flanging tool into individual tab-shaped securing elements and to bend them radially outwardly. For this purpose, the bottom part of the flanging tool is provided with a circular arrangement of widening depressions which are separated from one another by cutting edges that point toward the top part of the tool. After attachment to the carrier web, the securing elements form, viewed in cross-section, together with the eyelet disk a V-shaped folded product. The carrier web which is clamped between the legs of the V is secured only insufficiently in this folded product.

The invention is based, first, on the task of developing an inexpensive, quickly installable eyelet of the type indicated in the introductory clause of claim 1, which, after it has been attached to the carrier web, is characterized by high resistance to tear-out. This is achieved according to the invention by the measures cited in claim 1, to which the following meaning attaches:

In the invention, a ring-shaped profile is formed which extends across more that a complete circle because practically the entire length of the neck is rolled spirally into the interior of the ring-shaped profile when the neck is flanged over; the projections provided at the end of the neck are included in the formation of the spiral. As a result, special compression points, which provide very high resistance to the tensile stresses exerted on the carrier web, are produced on the gripped carrier web inside the spirally rolled-in ring-shaped profile. These compression points are formed because the projections on the spirally rolled-in ring-shaped, flanged-over neck press an area of the carrier web surrounding the hole against opposite support surfaces, which, in the case of the present ring-shaped profile, are formed by the plate or by the transition between the plate and the neck of the eyelet part. The carrier web adapts with a ring-segment shape to the ring-shaped profile and the rolled-in projections on the neck and is compressed in a sandwich-like fashion between the ring surfaces and the spiral surfaces. The carrier web extends beyond the compression points to the edge of the hole in the interior of the ring-shaped profile. The projections on the spirally shaped rolled-in end pieces of the neck point toward the interior of the ring-shaped profile and are oriented counter to the tensile loads occurring during use of the carrier web. In front of these real compression points a step-like increase of the web material takes place which upon stresses acting on the carrier web actually improve the grip at the compression points. The spiral rolling of the end piece of the neck provides a very clean riveting action without having to fear injuries being inflicted on the user. The eyelet according to the invention is much more resistant to pull-out than the state of the art indicated above.

In comparison with the much more complicated, two-part eyelets, the eyelet according to the invention provides a surprisingly high resistance to tear-out; it is, in fact, 30–75% stronger. This strength is obtained precisely in the case of the previously so difficult to handle flexible or stretchable carrier webs, which could not be processed at all with one-part eyelets in the past. Because of the one-piece design of the invention, the disk part is eliminated, which saves material, warehouse costs, freight costs, and handling during the installation process. Because the one-part eyelet part according to the invention can be installed rapidly, the cost of installing the eyelet is reduced. The neck of the eyelet part according to the invention must be long enough to make it possible for the desired ring-shaped profile to be obtained during the flanging operation. The thickness of the carrier web, of course, must also be taken into account. The only other step to be taken is to produce the axial or radial projections at the free end of the neck, which can be done in various ways.

One possibility is to form the projections by making radial holes in the tubular wall of the neck. When the neck is flanged over, these radial projections penetrate into the edge area of the material around the hole in the carrier web being gripped, where they dig themselves in and produce the compression points against the opposing support surface on the plate. The other possibility, namely, forming projections which proceed in the axial direction, is easier to manufacture, however. The pronged or wave-like terminal edge of the neck mentioned for this purpose in claim 2 is suitable. In this case, the entire edge of the neck has a continuous profile and does not, as in the state of the art mentioned above, show individual projections spaced a certain distance apart. When the ring-shaped profile is formed, both the neck and its projections are deformed jointly according to the invention. When the ring-shaped profile is produced during the flanging-over operation, the prong digs into the web material, and there is therefore not just a clamping effect between the prong and the opposing support surface of the plate but also a positive connection, which is established between the prong and the carrier web. The greater the tensile force exerted on the carrier web, the greater the strength with which the prongs dig into the web. This explains the surprisingly high resistance of the eyelet according to the invention to tear-out.

The invention also pertains to a device for installing the eyelet according to the invention. In the case of the known device (U.S. Pat. No. 1,838,973 A), which is intended for two-part eyelets, the thrust ring in the lower tool projects beyond the cutting edge provided here. The upper tool has an axially movable, central insert with a bore; this insert projects out axially beyond the adjacent surfaces of the upper tool. During the working stroke of the two tools, the carrier web is pushed by the central insert of the upper tool into the thrust ring before the central insert meets the cutting edge of the lower tool to cut the hole in the carrier web. The attachment of the carrier web to this two-part eyelet, which consists of both an eyelet part and the previously mentioned disk part, is therefore unattractive, because folds are formed in the carrier web.

The invention is therefore also based on the task of developing a device which can be used to attach the one-part eyelet cited in claim 1 more attractively to the carrier web and with greater resistance to tear-out. This is accomplished according to the invention by the features cited in the characterizing clause of claim 9, to which the following special meaning attaches:

In the invention, the upper tool is provided with a counter-thrust ring to work together with the thrust ring in the lower tool, the counter-thrust ring being subjected to a force acting toward the lower tool. It is recommended here, in accordance with claim 10, that these two rings be provided with opposing beveled surfaces. When the two tools perform their stroke, the carrier web is tensioned between the two rings, and the beveled surfaces exert an additional stretching and smoothing-out effect on the carrier web. During the following flanging operation of the one-part eyelet, the carrier web is kept flat and smooth, which ensures that the eyelet is attached ideally to the carrier web. The tensioning of the web minimizes the amount of material which is pulled into the eyelet. This has the result that spacing of the eyelets can be maintained with precision, and positional deviations can be limited even in the case of large tarps.

Additional measures and advantages of the invention can be derived from the subclaims, from the following description, and from the drawings. The drawings illustrate the invention on the basis of an exemplary embodiment:

FIG. 3 shows a greatly enlarged cross section through the installed eyelet according to FIG. 1 along the cross-sectional line III—III in FIG. 1;

FIG. 4 shows an axial cross section through the special eyelet part of the diskless eyelet according to the invention in the original state, that is, before it has been installed in the carrier web;

FIG. 5 shows an enlarged, flattened view of part of the edge area of the eyelet part according to the invention, namely, the area indicated by the "V" in FIG. 4.

Figure 1:
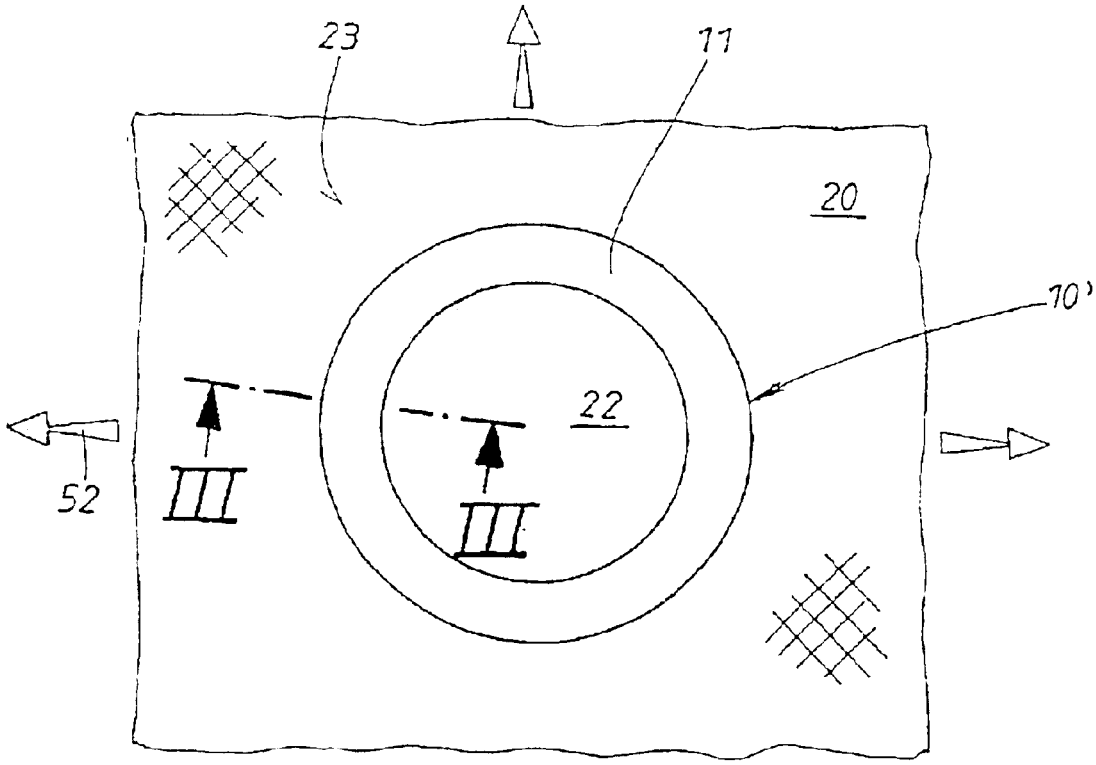
FIGS. 1 and 2 show top views of the visible side and the rear surface, respectively, of a carrier web equipped with an eyelet according to the invention.
Figure 2:
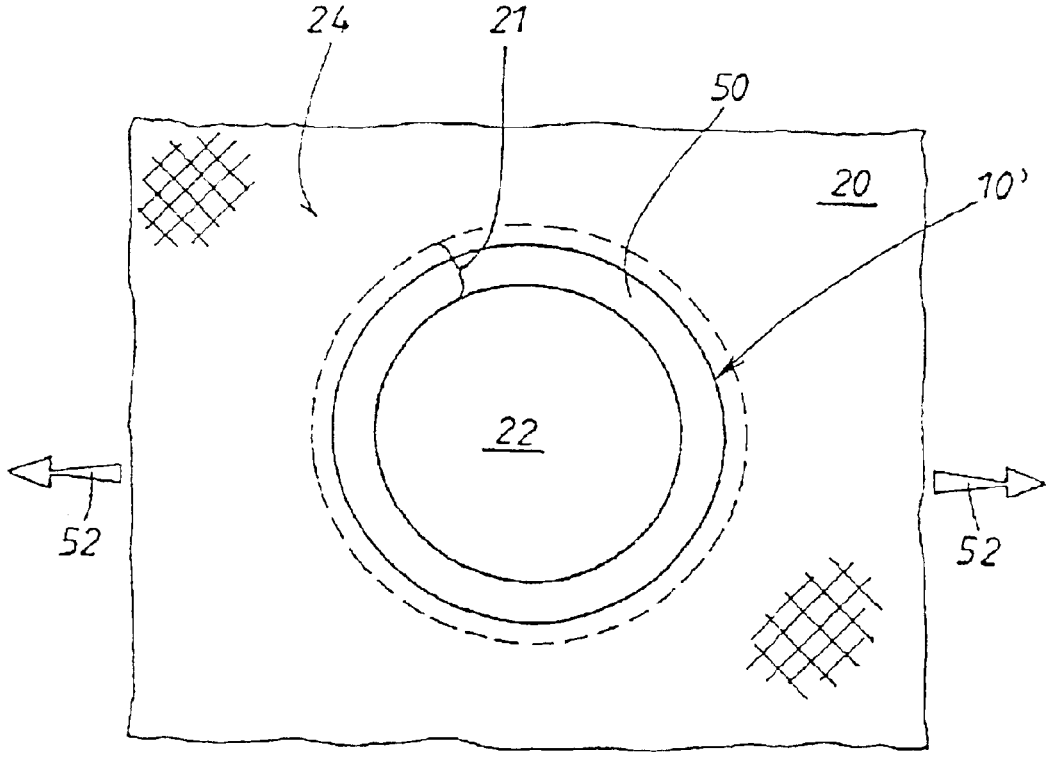

As FIGS. 1 and 2 show, an eyelet is to be used to reinforce the edge area 21 around a hole 22, which has been cut in a carrier web 20. The carrier web 20 is usually a flexible and possibly stretchable material such as an automobile tarp. According to the invention, the hole is reinforced with a one-piece eyelet part 10. In FIGS. 4 and 5, the eyelet part 10 is shown in its original state, before installation. FIGS. 1, 2, and 3, however, show the eyelet part 10' after installation, in its final state in which it is exercising its hole-reinforcing function.

As FIGS. 1 and 2 show, an eyelet is to be used to reinforce the edge area 21 around a hole 22, which has been cut in a carrier web 20. The carrier web 20 is usually a flexible and possibly stretchable material such as an automobile tarp. According to the invention, the hole is reinforced with a one-piece eyelet part 10. In FIGS. 4 and 5, the eyelet part 10 is shown in its original state, before installation. FIGS. 1, 2, and 3, however, show the eyelet part 10' after installation, in its final state in which it is exercising its hole-reinforcing function.

The eyelet part 10 can be divided into a plate 11 with a curved cross section, extending essentially in the radial direction, and a tubular neck 12, extending in the axial direction. To increase the dimensional stability of the eyelet and to make it easier to flange over the neck 12 into a ring, as will be described in greater detail below, the plate 11 is provided with a curved profile 13. As a result, an especially conspicuous arc-shaped transition 14 is obtained between the plate 11 and the neck 12. The neck is provided at its free end 15 with axial projections 16, which, therefore, extend in the direction of the neck 12. These projections consist in the present case of a curved, pronged terminal edge 17, as can be seen in FIG. 5. This edge has the following appearance.

The tips 17 of the prongs are provided with convexly rounded areas 27, whereas the gaps 18 between the prongs have concavely rounded areas 28. As a result, the pronged profile 19 acquires a wave-like form. The course of the waves is asymmetric. That is, the radius of curvature of the rounded areas 27 of the prong tips 17 is smaller than that of the rounded areas 28 of the gaps between the prongs.

Figure 6:
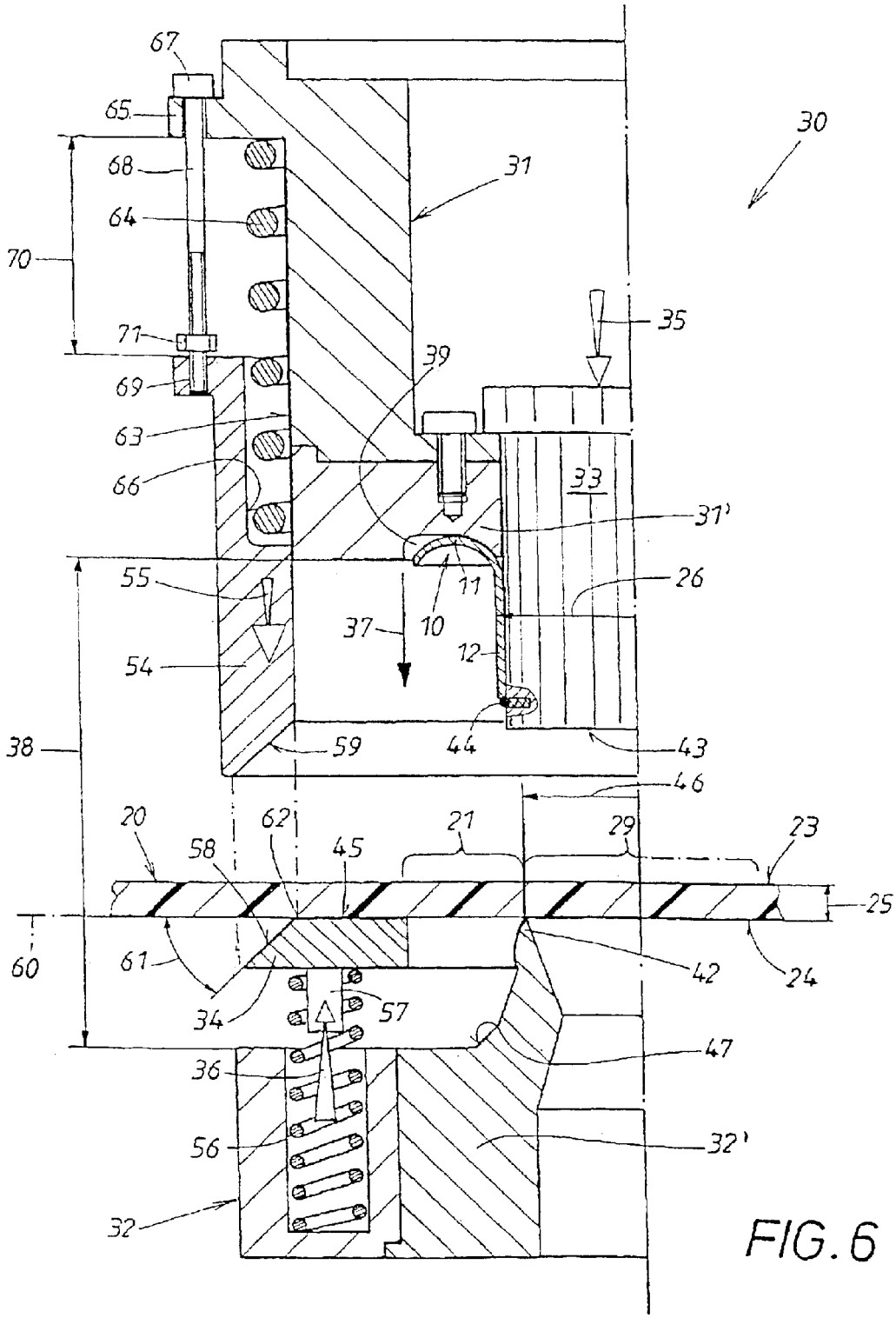
FIG. 6 shows an axial half-cross section of the parts of a two-part device according to the invention for installing the eyelet part shown in FIG. 4, the upper tool being at the top end of its stroke with respect to the lower tool.

This eyelet part 17 is attached to the carrier web 20 by the device 30, shown in FIG. 6. The device 30 consists of essentially five parts, which are able to move in the axial direction with respect to each other in a chronological sequence. These parts include, first, the bottom tool 32, which, in the present case, remains at rest and which carries a thrust ring 34, which is able to move passively in the axial direction with respect to the lower tool. In addition, the device 30 also includes an upper tool 31, which is able to move actively with respect to the lower tool 32 and which has a central, coaxial insert 33. This insert is also able to move passively in the axial direction with respect to the upper tool 31. Finally, the upper tool 31 is enclosed circumferentially by a counter-thrust ring 54, which is also able to move passively in the axial direction. The central insert 33 and the counter-thrust ring 54 are subjected to load in the direction of the force arrows 35 and 55 toward the lower tool 32, whereas the thrust ring 34 in the lower tool 32, in mirror-image fashion, is acted upon by a group of springs 56 acting in the direction of the force arrow 36 toward the upper tool 31, these springs being installed in axial holes in the bottom tool 32. The springs 56 are designed as helical springs, and pins 57 seated on the thrust ring 34 fit into the interior of the helical turns. The tool assembly 31, 33, 54 on the one side and the tool assembly 32, 34 on the other are able to move up and down with respect to each other, as indicated by the motion arrow 37 of the upper tool assembly 31, 33, 54.

The counter-thrust ring 54 is guided on the circumferential surface 63 of the upper tool 31. The force 55 exerted by the counter-thrust ring 54 is produced by a compression spring 64, which is supported between a flank of a circumferential flange 65 on the upper tool 31 and the contact surface of a cutaway portion 66 of the counter-thrust ring 54. The extent to which the counter-thrust ring 54 extends outward is determined by end stops. These consist in the present case of the heads 67 of a group of guide rods 68, the length of which can be adjusted by the use of a threaded section 69 and a lock nut 71. When in the resting state, the head 67 of the rod is supported on the top surface of the flange 65. As a result, the desired extension 70 of the counter-thrust ring 54 relative to the upper tool 31 is determined.

FIG. 6, as already mentioned, shows the device at the upper reversal point of its stroke 37, at which the maximum distance 38 is present between the upper tool 31 and the lower tool 32. As a result, an eyelet part 10 can be conveniently inserted into the receiving profile of the upper tool 31 and around the central insert 33. For this purpose, the upper tool 31 has a receptacle 39, which conforms to the profile of the plate 11. The area provided with the receptacle 39 is subject to wear during normal use. To facilitate the renewal of a worn-out device 30, therefore, the lower part of the upper tool is provided with an insert 31', which is detachably connected to the upper part of the upper tool 31 by suitable means such as the screw shown in the drawing or the like. This insert 31' carries the receptacle 39.

After the eyelet part 10 has been inserted, the end of the neck 20 is supported on the circumferential surface of the central insert 33. The central insert 33 is provided with a flat end surface 43. To secure the eyelet part in position in the tools 31, 33, a retaining element 44, which, in the present case, consists of a radially spring-loaded pin, is used, which is located in the circumferential area of the central insert 33.

The carrier web 20 is laid between the two tool parts 31, 32; at this point, the web is still unperforated. The previously mentioned springs 56 hold the thrust ring 34 in a defined starting position, shown in FIG. 6. At maximum stroke of the tool, the defining-upper surface 45 of the thrust ring 34 is located above or preferably at the same level as a cutting edge 42 provided on the cutting tool 32. As a result, a horizontal support plane 60 for the carrier web 20, illustrated in broken line in FIG. 6, is created at the thrust ring 34.

During the downstroke 37 of the upper tool assembly 31, 33, 54, the leading counter-thrust ring 54 makes contact first with the carrier web 20 lying on top of the thrust ring 34. The two rings 34, 54 are provided with bevels 58, 59, which are essentially parallel to each other and which grip the carrier web 20 between them, as a result of which the carrier web 20 is initially put under a certain amount of tension. The bevel 58 of the thrust ring 34 forms an acute angle 61 to the support plane 60, shown in dash-dot line in FIG. 6, which plane is determined by the end surface 45 of the thrust ring 34 serving to support the carrier web 20. The counter-thrust surface 59 of the thrust ring 54 just mentioned is essentially parallel to the thrust surface 58. When the two tools 31, 32 are moved toward each other 37, therefore, the carrier web 20 is pulled over the edge 62, which is formed between the end surface 45 and the bevel 58 of the thrust ring 34. As a result, the carrier web is drawn flat in the area 29 to be punched. The carrier web 20 thus assumes a stretched-out condition in the support plane 60 mentioned.

Then the central insert 33, under the force being exerted by the press plunger, makes contact with the upward-facing, visible side 23 of the carrier web 20, thus pressing it against the cutting edge 42 of the lower tool 32, which is resting against the bottom surface 24 of the carrier web. As a result, a circular hole is punched out of the carrier web 20. The radius 46 of the hole determined by the cutting edge 42 is smaller than the radius 26 of the neck 12 of the eyelet indicated at 26 in FIG. 6.

When the upper tool 31 is lowered further in the direction of the stroke arrow 37, the carrier web 20 is pulled even tighter between two bevels 58, 59 of the two rings 34, 54. The neck 12 of the eyelet part 10 continues to pass through the hole thus formed and into the lower tool until the plate 11 of the eyelet part 10 arrives at the thrust ring 34, the carrier web 20 ending up between the plate and the ring. During this downward movement 37, the upper tool 31 overcomes the elastic force 36 being exerted from underneath by the thrust ring 34, and the neck 12 of the eyelet and its axial projections 16 are flanged over against the flanging profile 47 of the lower tool 32. The elastic force 54 of the thrust ring 34 acting from above is weaker than the ejection force 36 acting from below on the thrust ring 34. As in the case of the upper tool 31, the lower tool 32 also has an insert 32', positioned in the axial area, which carries the defining flanging-over profile 47. This flanging-over profile 47 wears out after prolonged use. At that point, it necessary merely to replace this insert 32'.

During the flanging operation, the special riveting relationships shown in FIG. 3 are obtained. Practically the entire length 48 of the neck of the eyelet part shown in FIG. 4 is rolled up into a ring-shaped profile 50, shown in FIG. 3, on the rear surface 24 of the carrier web 20. The neck projections 16 are rolled up inside this ring-shaped formation 50. These neck projections 16 are pressed against an opposing support surface 49, provided by the previously described curved section 13 of the plate 11; the previously mentioned area 21 of the carrier web 20 situated around the edge of the hole as indicated in FIG. 6 ends up between the projections and the opposing support. As a result, the compression points 40, which proceed around the plate in a ring-like manner, are obtained, as can be seen in FIG. 3. The end part 41 of the carrier web 20 continues into the interior 51 of the ring-shaped profile, conforming to the profile 50 and thus acquiring the form of a segment of a ring. The bevels 58, 59 continue to hold the carrier web firmly in place while the end part 41 is being rolled up during the riveting process.

When the eyelet part installed on the carrier web 20 is properly used, the tensile forces indicated by the force arrows 52 in FIGS. 1–3 will occur. These tensile stresses 52 are absorbed at the compression points 40. First, a clamping action between the neck projections 16 and the opposing support surface 49 is present at the compression points 40. There is also a positive interconnection because of the profiling 19 of these projections 16, as described above. That is, the tips 17 of the prongs dig into the web material, but, because of the rounded areas 27, 28 of the pronged edge 19, the web 20 is not torn. A notch effect is thus avoided. On the other side of these compression points 40, as designated at 53 in FIG. 3, the web becomes thicker again in front of the prong tips and also in the curved gaps 18 between the prongs. That is, the web 40 tries to return to its original thickness 25 at 53. Under the tensile stresses 52 on the web 20, the wave-like edges of the neck projections 16 dig into these step-like areas of increased thickness 53 of the web material 20. The positive interlocking is thus improved even more, and the eyelet part 10' riveted into the web 20 thus acquires a surprisingly high degree of tensile strength.

LIST OF REFERENCE NUMBERS

10 eyelet part (original state, FIG. 4)
10' riveted state of 10 (FIGS. 1–3)

11 plate of 10
12 neck of 10, eyelet neck
13 curved profile of 11
14 arc-shaped transition between 11 and 12
15 end part of 12
16 axial projection of the neck at 15 (FIG. 4)
17 tip of prong (FIG. 5)
18 gap between prongs
19 pronged edge at 15 (FIG. 5)
20 carrier web
21 area at edge of hole in 20
22 hole in 20
23 visible side of 20
24 rear surface of 20
25 web thickness of 20 (FIG. 6)
26 radius of neck 12 (FIG. 6)
27 convexly rounded area of 17 (FIG. 5)
28 concavely rounded area of 18 (FIG. 5)
29 hole punching from 20 (FIG. 6)
30 device
31 upper tool of 30
31' replaceable insert in 31
32 lower tool of 30
32' replaceable insert in 32
33 central insert in 31
34 thrust ring in 33
35 force arrow of 33
36 arrow of the elastic force of 34
37 stroke arrow of 31 with respect to 32 (FIG. 6)
38 maximum stroke between 31 and 32
39 receptacle in 31 for 11
40 compression point of 20 between 16 and 49 (FIG. 3)
41 end part of 20 on the other side of 40 (FIG. 3)
42 cutting edge of 32
43 flat end surface of 33 (FIG. 6)
44 retaining element for 10 at 33 (FIG. 6)
45 end surface for 20 on 34
46 radius of hole 29 (FIG. 6)
47 flanging profile of 32 (FIG. 6)
48 length of neck 12 (FIG. 4)
49 opposing support surface on 11 for 16 (FIG. 3)
50 ring-shaped profile of 12 at 10' (FIG. 3)
51 interior of the ring-shaped profile of 50 (FIG. 4)
52 arrow of the tensile force on 20
53 step-like increase in the thickness of 20 behind 40 (FIG. 3)
54 counter-thrust ring
55 force of 54
56 spring for 36
57 pin on 34 for 56
58 bevel of 34, beveled surface
59 counter-bevel of 54, counter-beveled surface
60 support plane
61 angle of 58 with respect to 45
62 edge between 45 and 58 of 34
63 circumferential surface of 31
64 compression spring
65 flange
66 cutaway area
67 head of 68
68 guide rod
69 threaded engagement
70 extension
71 lock nut

What is claimed is:

1. Eyelet for reinforcing the area (21) around the edge of a hole (22) in a carrier web (20), with a diskless eyelet part (10, 10=), consisting of a plate (11), which rests on the visible side (23) of the carrier web (20); of a tubular neck (12), which passes through the hole (22); and of an arc-shaped transition (14) between the plate (11) and the neck (12);

where the free end part (15) of the neck (12) is provided with projections (16), which extend in the axial and/or the radial direction; and where, after the riveting operation, a flanging of the neck (12) of the eyelet part (10=) is present on the rear surface (24) of the carrier web (20), wherein the completed flanging of the neck (12) extends across more than a closed, ring-shaped profile (50) because practically the entire length (48) of the neck is rolled spirally into an interior (51) of the ring-shaped profile and the projections (16) of the end part (15) of the neck (12) are included in the spiral thus formed; wherein, in the spiral interior of the ring-shaped profile (50), the projections (16) of the neck (12) press against an opposing support surface (49) formed by the plate (11) or by the transition area (14), the area (21) of the carrier web (20) around the edge of the hole ending up between the projections and the support surface, areal compression points (40) thus being produced on the gripped carrier web (20), as a result of which a step-like increase (53) in the thickness of the web material is formed in front of the compression points; wherein, in the interior (51) of the ring-shaped profile, the end part (41) of the carrier web (20) extends beyond the areal compression points (40) to the edge of the hole and forms a segment of a ring conforming to the shape of the ring-shaped profile (50); and wherein, when tensile stresses are exerted on the carrier web, the projections (16) engage positively with the step-like increase (53) in the thickness of the web material and oppose the tensile forces, wherein the axial projections (16) on the neck consist of a pronged edge (19) at the end of the neck (12).

2. Eyelet according to claim 1, wherein the tips (17) of the prongs are convexly rounded, in that the gaps (18) between the prongs are concavely rounded, and in that the two rounded areas (27, 28) define a wave-like course of the pronged edge (19).

3. Eyelet according to claim 2, wherein the pronged edge (19) is asymmetrically wave-like.

4. Eyelet according to claim 2, wherein the convexly rounded areas (27) of the prong tips (17) are smaller than the concavely rounded areas (28) of the prong gaps (18).

5. Eyelet according to claim 1, wherein the material of the carrier web (20) is flexible or stretchable or flexible and stretchable.

6. Eyelet according to claim 5, wherein the carrier web (20) consists of a canvas tarp.

7. Eyelet according to claim 5, wherein the carrier web (20) consists of a reinforced plastic sheet.

8. Device (30) for installing eyelet parts (10) in a carrier web (20) according to claim 1, with a lower tool (32), which is equipped with the flanging-over profile (47) for the neck (12) of the eyelet part (10) and which also has a ring-shaped cutting edge (42);

with an upper tool (31), which holds the eyelet part (10), can move up and down (37) relative to the lower tool (32), and has a central insert (33), which is able to move in the axial direction against an elastic force (35);

where the carrier web (20) is positioned between the two tools (31, 32), and the cutting edge (42) of the lower tool (32) works with the end surface (43) of the central insert (33) to exert a hole-cutting action (29) on the carrier web (20) situated between them;

with a thrust ring (34) in the lower tool (32), which is located a certain radial distance away from the flanging profile (47) and is subjected to a force (36) directed toward the upper tool (31);

where the radius (46) of the hole of the cutting edge (42) is smaller than the outside radius (26) of the neck (12) of the eyelet part (10), wherein the end surface (43) of the central insert (33) is essentially flat and free of pretensioning pins which prestretch the carrier web (20); in that at the point of maximum stroke between the two tools (31, 32), the thrust ring (34) is located essentially on the same level as the cutting edge (42) of the lower tool (32) and works together with the cutting edge (42) to form a support plane (60) for the carrier web (20) to be placed between the two tools (31, 32); in that a counter-thrust ring (54) in the upper tool (31) is associated with the thrust ring (34) and is subject to a force (55) directed toward the lower tool (32); and in that the carrier web (20) is tensioned between the two rings (34, 54) during the stroke (37) of the tools.

9. Device according to claim 8, wherein the two rings (34, 54) are provided with opposing beveled surfaces (58, 59), which face each other, and which tension the carrier web (20) between them during the working stroke of the tools (31, 32).

10. Device according to claim 9, wherein the beveled surface (58) and the support plane (60) form an acute angle (61) pointing in the direction (37) of the stroke, the support plane being determined by the support surface (45) of the thrust ring (34); and in that the opposing beveled surface (59) of the counter-thrust ring (54) is essentially parallel to the beveled surface (58) of the thrust ring (34).

11. Device according to claim 8, wherein a helical compression spring has a ring-shaped end surface, and in that this terminal ring-shaped surface forms the thrust ring (34), while the compression spring produces the force (36).

* * * * *